US007202611B2

(12) United States Patent
Matsuura

(10) Patent No.: US 7,202,611 B2
(45) Date of Patent: Apr. 10, 2007

(54) DISCHARGE LAMP LIGHTING DEVICE

(75) Inventor: Ken Matsuura, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 11/398,665

(22) Filed: Apr. 6, 2006

(65) Prior Publication Data

US 2006/0226793 A1 Oct. 12, 2006

(30) Foreign Application Priority Data

Apr. 7, 2005 (JP) ..... 2005-110787

(51) Int. Cl.
*G05F 1/00* (2006.01)

(52) U.S. Cl. ..... 315/291; 315/307; 315/287; 315/312; 315/224

(58) Field of Classification Search ..... 315/291, 315/307, 308, 287, 312, 224
See application file for complete search history.

(56) References Cited

U.S. PATENT DOCUMENTS 5,952,793 A * 9/1999 Nishi et al. ..... 315/307
6,348,755 B1 * 2/2002 Shimamura et al. ..... 310/318

FOREIGN PATENT DOCUMENTS

JP A 2000-058289 2/2000
JP A 2003-323994 11/2003
JP A 2004-241136 8/2004

* cited by examiner

*Primary Examiner*—Tuyet Thi Vo
(74) *Attorney, Agent, or Firm*—Oliff & Berridge, PLC

(57) ABSTRACT

A device for lighting a discharge lamp has a drive circuit to feed alternating power the discharge lamp, and a control circuit. The control circuit controls the drive circuit by a drive pulse to perform a burst dimming control over the discharge lamp. The control circuit has detector, subtractor, a digital filter, and pulse generator. The subtractor subtracts the detected lamp current by the detector from a reference value. The digital filter integrates the output of the subtractor as an integrator. The pulse generating means generates the drive pulse based on the output of the digital filter. The lighting time period has a first time period immediately after a start of the lighting time period and a second time period following the first time period. The control circuit sets the reference value to a target current value in the second time period. The control circuit increase the reference value in the first time period to the target current value until an end of the first time period. The digital filter retains the output obtained at an end of the lighting time period until a next lighting time period starts. The control circuit adjusts the lamp current to the target current value during the lighting time period.

2 Claims, 6 Drawing Sheets

FIG.2A TIME
FIG.2B RESET SIGNAL SR
FIG.2C REFERENCE VALUE REF
FIG.2D OUTPUT OF DIGITAL FILTER
FIG.2E CONTROL SIGNAL H1m, H2m L1m, L2m
FIG.2F CONTROL SIGNAL H1s, H2s L1s, L2s
FIG.2G LAMP CURRENT I
ON
OFF
Io
Ii
0
T0
TON
TOFF
T1
T2
t1
t2
t3
t4

FIG.5A TIME
FIG.5B RESET SIGNAL SR
FIG.5C REFERENCE VALUE REF
FIG.5D OUTPUT OF DIGITAL FILTER
FIG.5E CONTROL SIGNAL H1, H2 L1, L2
FIG.5F LAMP CURRENT I
ON
OFF
Io
Ii
0
0
ON
OFF
0
T0
TON
TOFF
TON
TOFF
TON
TOFF
T1
T2
t1
t2
t3
t4

DISCHARGE LAMP LIGHTING DEVICE

TECHNICAL FIELD

The present invention relates to a discharge lamp lighting device which controls the lighting of a discharge lamp having two electrodes. In particular, the present invention relates to a discharge lamp lighting device that controls a discharge lamp used as a backlight for various display panels such as big screen television sets.

BACKGROUND

In recent years, a CCFL (Cold Cathode Fluorescent Lamp) has been used as a backlight of an LCD display for a computer or an LCD TV. A burst dimming control is used in order to control the brightness of the discharge lamp used for the above equipment, thereby alternately appearing a lighting time period for lighting the discharge lamp and a lights-off time period for turning off the discharge lamp.

In the burst dimming control, a lamp current flowing through the discharge lamp is required to be controlled to have a target brightness value over the entire lighting time period. However, it usually takes time to increase the lamp current up to the target value within a predetermined lighting time period. Overshoot of the lamp current sometimes occurs immediately after the start of the lighting time period. Thus, control for adjusting the lamp current to the target value within a short time is generally difficult.

An object of the present invention is to provide a discharge lamp lighting device capable of controlling a lamp current to a target value within a short time while preventing occurrence of overshoot when lighting the discharge lamp using burst dimming control.

SUMMARY

The present invention provides a discharge lamp lighting device for lighting a discharge lamp. The discharge lamp lighting device has a drive circuit and a control circuit. The drive circuit is connectable to the discharge lamp to feed alternating power having high frequency to the discharge lamp, thereby flowing a lamp current through the discharge lamp. The control circuit generates a drive pulse to drive the drive circuit to perform a burst dimming control over the discharge lamp, thereby alternately appearing a lighting time period for lighting the discharge lamp and a lights-off time period for turning off the discharge lamp.

The control circuit has detecting means, subtracting means, a digital filter, and pulse generating means. The detecting means detects the lamp current. The subtracting means subtracts the detected lamp current from a reference value to obtain a difference therebetween as an output. The digital filter operates as an integrator to integrate the output of the subtracting means to obtain an output. The pulse generating means generates the drive pulse based on the output of the digital filter.

The lighting time period has a first time period immediately after a start of the lighting time period and a second time period following the first time period. The second time period is longer than the first time period. The control circuit sets the reference value to a target current value in the second time period. The control circuit increase the reference value in the first time period to the target current value until an end of the first time period. The digital filter retains the output obtained at an end of the lighting time period until a next lighting time period starts. The control circuit adjusts the lamp current to the target current value during the lighting time period.

The present invention provides a discharge lamp lighting apparatus for lighting a discharge lamp having two electrodes. The discharge lamp lighting apparatus has a first drive circuit, a second drive circuit, and a control circuit. The first drive circuit is connectable to one of the two electrodes to feed first alternating power having high frequency to the discharge lamp. The second drive circuit is connectable to the other of the two electrodes to feed a second alternating power to the discharge lamp, the second alternating power having the same frequency as the first alternating power. The control circuit generates first and second drive pulses to drive the first and second drive circuits, respectively, to flow a lamp current through the discharge lamp. The control circuit performing a burst dimming control over the discharge lamp, thereby alternately appearing a light time period for lighting the discharge lamp and a lights-off time period for turning off the discharge lamp.

The control circuit has detecting means, subtracting means, a digital filter, and pulse generating means. The detecting means detects the lamp current. The subtracting means subtracts the detected lamp current from a reference value to obtain a difference therebetween as an output. The digital filter operates as an integrator to integrate the output of the subtracting means to obtain an output. The pulse generating means generates the first and second drive pulse based on the output of the digital filter.

The lighting time period has a first time period immediately after a start of the lighting time period and a second time period following the first time period, the second time period being longer than the first time period. The control circuit sets the reference value as a target current value in the second time period. The control circuit increases the reference value in the first time period to the target current value until an end of the first time period. The digital filter retains the output obtained at an end of the lighting time period until a next lighting time period starts. The control circuit adjusts the lamp current to the target current value during the lighting time period.

BRIEF DESCRIPTION OF THE DRAWINGS

The aforementioned aspects and other features of the invention are explained in the following description, taken in connection with the accompanying drawing figures wherein.

DETAILED DESCRIPTION

An embodiment according to the present invention will be described below with reference to the accompanying drawings.

Figure 1:
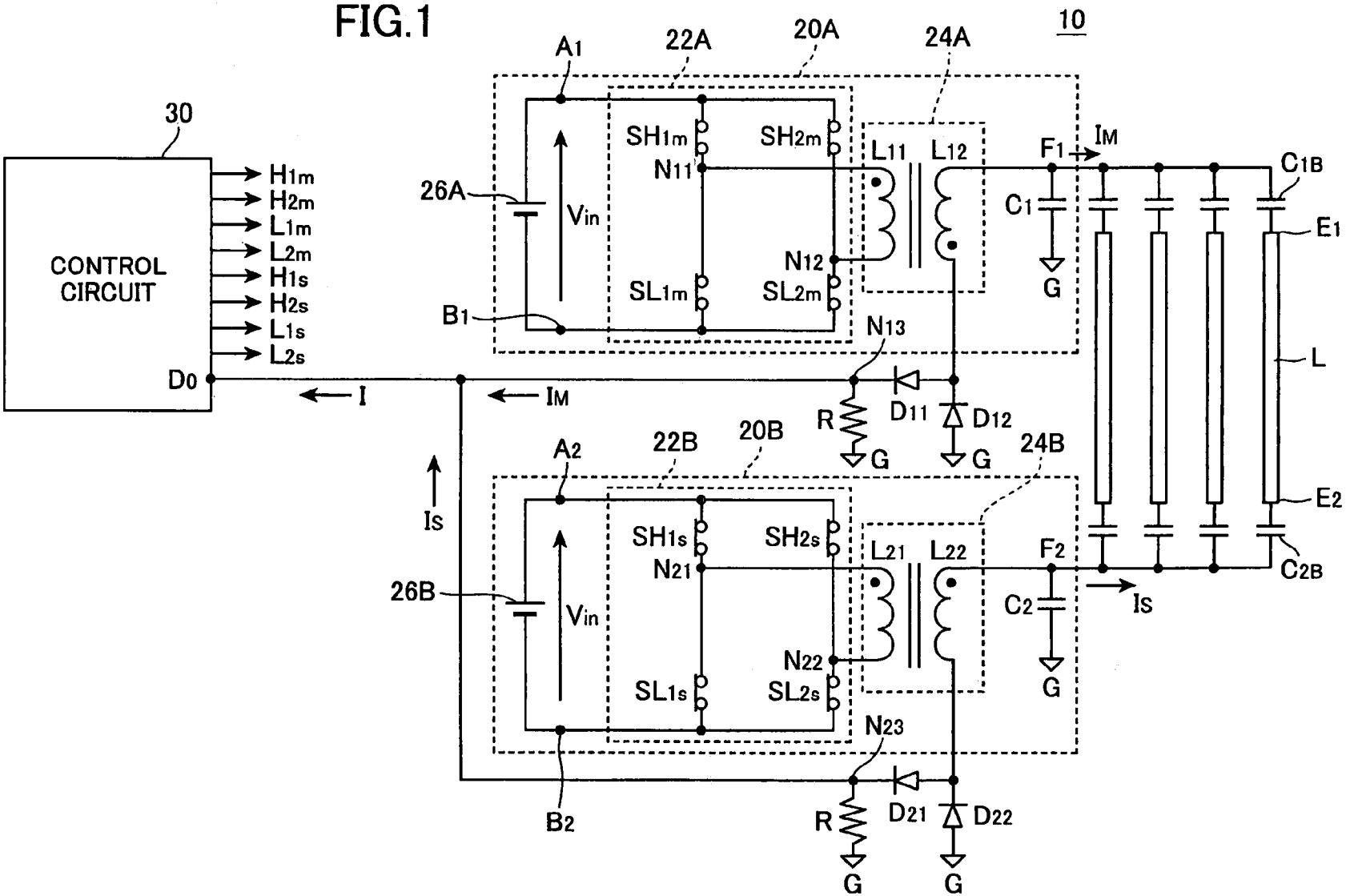
FIG. 1 is a circuit diagram showing a discharge lamp lighting device according to a first embodiment of the present invention.

FIG. 1 shows a discharge lamp lighting device 10 according to an embodiment of the present invention. The discharge lamp lighting device 10 feeds electric power from a power supply to a discharge lamp L to light the discharge lamp L. The discharge lamp lighting device 10 includes a master circuit 20A, a slave circuit 20B, and a controller 30. The discharge lamp L controlled by the discharge lamp lighting device 10 is a CCFL that has electrodes $E_1$, $E_2$ at both ends thereof, respectively.

The master circuit 20A includes a first inverter circuit 22A, a first transformer 24A, and a first resonant capacitor $C_1$. A direct-current (DC) power supply 26A is connected to input terminals $A_1$, $B_1$ of the first inverter circuit 22A, so that a DC voltage $V_{in}$ from the DC power supply 26A is applied across the first inverter circuit 22A. The terminal $B_1$ is positioned at a lower potential than the terminal $A_1$.

The first inverter circuit 22A is a full-bridge type of inverter having four switching elements $SH_{1m}$, $SL_{1m}$, $SH_{2m}$, and $SL_{2m}$. The switching elements $SH_{1m}$, $SL_{1m}$ are connected in series between input terminals $A_1$, $B_1$. The switching elements $SH_{1m}$ is positioned at a higher potential than the switching elements $SL_{1m}$. The switching elements $SH_{2m}$, $SL_{2m}$ are connected in series between the input terminals $A_1$, $B_1$. The switching elements $SH_{2m}$ is positioned at a higher potential than the switching elements $SL_{2m}$. The connecting point $N_{11}$ between the switching elements $SH_{1m}$, $SL_{1m}$ and the connecting point $N_{12}$ between the switching elements $SH_{2m}$, $SL_{2m}$ are a pair of output terminals of the first inverter circuit 22A. In this embodiment, the switching elements $SH_{1m}$, $SL_{1m}$, $SH_{2m}$, and $SL_{2m}$ are configured by semiconductor switching elements such as field-effect transistors. The switching operations of the switching elements $SH_{1m}$, $SL_{1m}$, $SH_{2m}$, and $SL_{2m}$ are controlled by control signals $H_{1m}$, $H_{2m}$, $L_{1m}$, and $L_{2m}$ supplied from the controller 30, respectively. When supplied with the control signal having a high level, the switching element turns on. When supplied with the control signal having a low level, the switching element turns off.

The first transformer 24A includes a primary coil $L_{11}$ and a secondary coil $L_{12}$ which are wound in the manner that the polarity of the primary coil $L_{11}$ is oriented in the opposite direction to the polarity of the secondary coil $L_{12}$. The primary coil $L_{11}$ has two connecting ends connected to the output terminals $N_{11}$, $N_{12}$ of the first inverter circuit 22A, respectively. The secondary coil $L_{12}$ is connected to a reference potential G through one connecting end thereof, a diode $D_{11}$, a node $N_{13}$, and a resistor R. The diode $D_{11}$ and the resistor R are connected in series. The diode $D_{11}$ has an anode connected to the one connecting end of the secondary coil $L_{12}$, and a cathode connected to the node $N_{13}$. A current passes from the connecting end of the secondary coil $L_{12}$ to the reference potential G through the diode $D_{11}$ and the resistor R. The resistor R has a higher potential terminal connected to a current detecting terminal $D_0$ of the controller 30. A diode $D_{12}$ is connected between the secondary coil $L_{12}$ and the reference potential G. The diode $D_{12}$ has an anode connected to the reference potential G and a cathode connected to the one connecting end of the secondary coil $L_{12}$.

The first resonant capacitor $C_1$ is connected in parallel to the secondary coil $L_{12}$. One end of the first resonant capacitor $C_1$ is connected to the reference potential G. The first resonant capacitor $C_1$ has another end connected to another connecting end of the secondary coil $L_{12}$. A node between the first resonant capacitor $C_1$ and the secondary coil $L_{12}$ is an output terminal $F_1$ of the master circuit 20A. The output terminal $F_1$ is electrically connected to the discharge lamp L through a ballast capacitor $C_{1B}$ and the electrode $E_1$. The master circuit 20A supplies a first alternating current $I_M$ through the output terminal $F_1$ to the discharge lamp L.

The slave circuit 20B includes a second inverter circuit 22B, a second transformer 24B, and a second resonant capacitor $C_2$. A DC power supply 26B is connected to input terminals $A_2$, $B_2$ of the second inverter circuit 22B, so that a DC voltage $V_{in}$ from the DC power supply 26B is applied across the second inverter circuit 22B. The terminal $B_2$ is positioned at a lower potential than the terminal $A_2$.

The second inverter circuit 22B is a full-bridge type of inverter having four switching elements $SH_{1s}SL_{1s}$, $SH_{2s}$, and $SL_{2s}$. The switching elements $SH_{1s}$, $SL_{1s}$ are connected in series between input terminals $A_2$, $B_2$. The switching elements $SH_{1s}$ is positioned at a higher potential than the switching elements $SL_{1s}$. The switching elements $SH_{2s}$, $SL_{2s}$ are connected in series between the input terminals $A_2$, $B_2$. The switching elements $SH_{2s}$ is positioned at a higher potential than the switching elements $SL_{2s}$. The connecting point $N_{21}$ between the switching elements $SH_{1s}$, $SL_{1s}$ and the connecting point $N_{22}$ between the switching elements $SH_{2s}$, $SL_{2s}$ are a pair of output terminals of the second inverter circuit 22B. In this embodiment, the switching elements $SH_{1s}$, $SL_{1s}$, $SH_{2s}$, and $SL_{2s}$ are configured by semiconductor switching elements such as field-effect, transistors. The switching operations of the switching elements $SH_{1s}$, $SL_{1s}$, $SH_{2s}$, and $SL_{2s}$ are controlled by control signals $H_{1s}$, $H_{2s}$, $L_{1s}$, and $L_{2s}$ supplied from the controller 30, respectively. When supplied with the control signal having a high level, the switching element turns on. When supplied with the control signal having a low level, the switching element turns off.

The second transformer 24B includes a primary coil $L_{21}$ and a secondary coil $L_{22}$ which are wound in the manner that the polarity of the primary coil $L_{21}$ is oriented in the same direction to the polarity of the secondary coil $L_{22}$. The primary coil $L_{21}$ has two connecting ends which are connected to the output terminals $N_{21}$, $N_{22}$ of the second inverter circuit 22B, respectively. The secondary coil $L_{22}$ is connected to the reference potential G through one connecting end thereof, a diode $D_{21}$, a node $N_{23}$, and a resistor R. The diode $D_{21}$ and the resistor R are connected in series. The diode $D_{21}$ has an anode connected to the one connecting end of the secondary coil $L_{22}$, and a cathode connected to the node $N_{23}$. A current passes from the connecting end of the secondary coil $L_{22}$ to the reference potential G through the diode $D_{21}$ and the resistor R. The resistor R has a higher potential end connected to the current detecting terminal $D_0$ of the controller 30. A diode $D_{22}$ is connected between the secondary coil $L_{22}$ and the reference potential G. The diode $D_{22}$ has an anode connected to the reference potential G and a cathode connected to the one connecting end of the secondary coil $L_{22}$. In this embodiment, the resistor R of the master circuit 20A has the same resistance value as that of the slave circuit 20B.

The second resonant capacitor $C_2$ is connected in parallel to the secondary coil $L_{22}$. One end of the second resonant capacitor $C_2$ is connected to the reference potential. The second resonant capacitor $C_2$ has another end connected to another connecting end of the secondary coil $L_{22}$. A node between the second resonant capacitor $C_2$ and the secondary coil $L_{22}$ is an output terminal $F_2$ of the slave circuit 20B. The output terminal $F_2$ is electrically connected to the discharge lamp L through a ballast capacitor $C_{2B}$ and the electrode $E_2$.

The slave circuit 20B supplies a second alternating current $I_S$ through the output terminal $F_2$ to the discharge lamp L.

Figure 2:
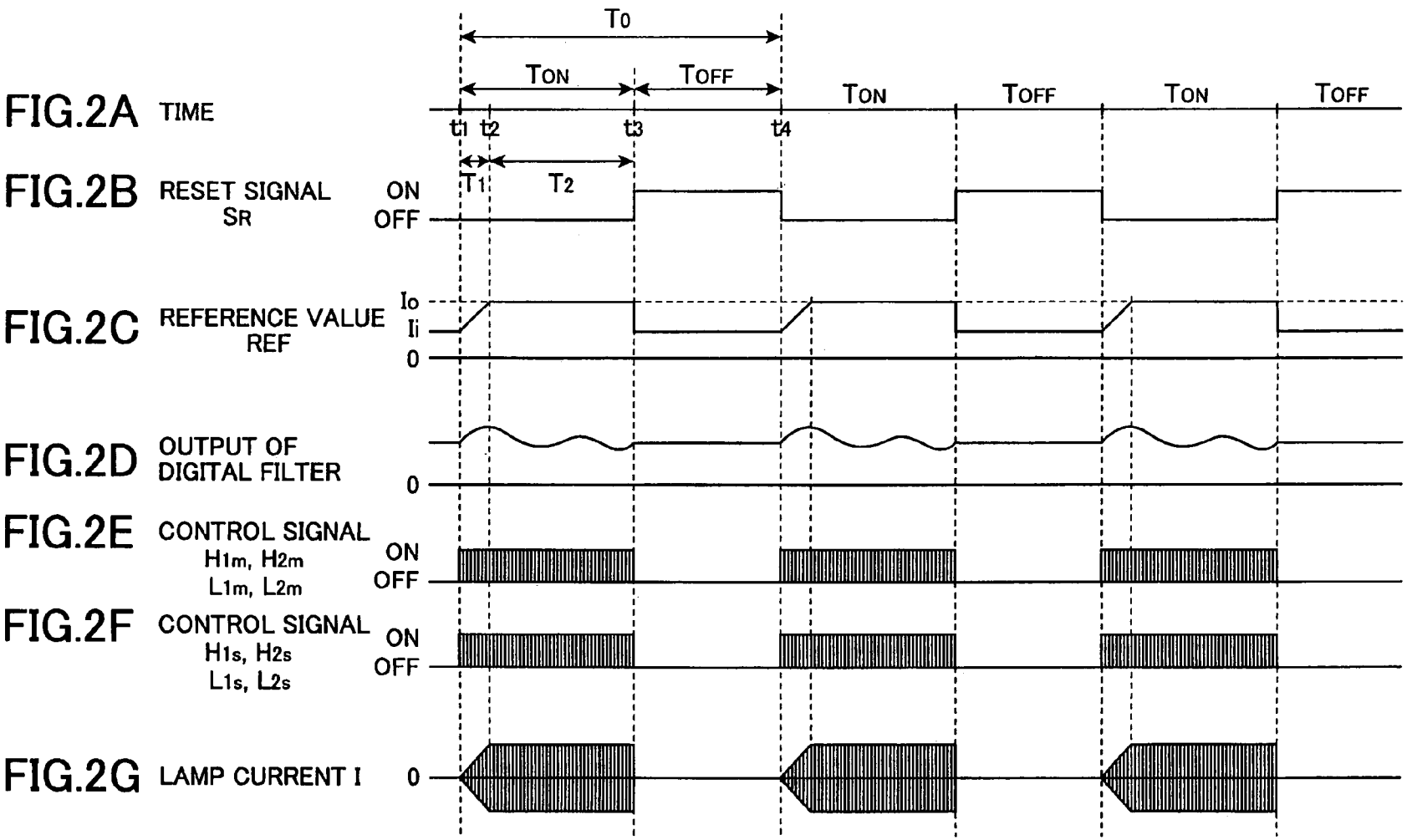
FIGS. 2A to 2G are waveform diagrams of control signals generated by a control circuit, a reference value REF used in the control circuit, and a lamp current.

The control circuit 30 is formed of a digital circuit. The control circuit 30 generates control signals $H_{1m}$, $H_{2m}$, $L_{1m}$, $L_{2m}$, $H_{1S}$, $H_{2S}$, $L_{1S}$, and $L_{2S}$ for the corresponding the switching elements $SH_{1m}$, $SL_{1m}$, $SH_{2m}$, $SL_{2m}$, $SH_{1S}$, $SL_{1S}$, $SH_{2S}$, and $SL_{2S}$ to perform a burst dimming control over the discharge lamp L to light the discharge lamp L. In the burst dimming control, one cycle consists of a lighting time period $T_{on}$ in which the discharge lamp L emits light and a lights-off time period $T_{off}$ in which the discharge lamp L extinguishes light, and the cycle is repeated as shown in FIG. 2. The ratio between the lighting time period $T_{on}$ and lights-off time period $T_{off}$ is determined depending on a target brightness value of the discharge lamp L. The control circuit 30 detects the first alternating current $I_M$ and second alternating current $I_S$ flowing through the discharge lamp L as a lamp current I through the current detection terminal $D_0$. And then, the control circuit 30 performs a feedback control for the lamp current I to light the discharge lamp L at a target brightness. That is, the control circuit 30 controls the switching operations of the switching elements in each of the master circuit 20A and slave circuit 20B based on the detected lamp current value I, thereby adjusting the first alternating current $I_M$ and second alternating current $I_S$.

Figure 3:
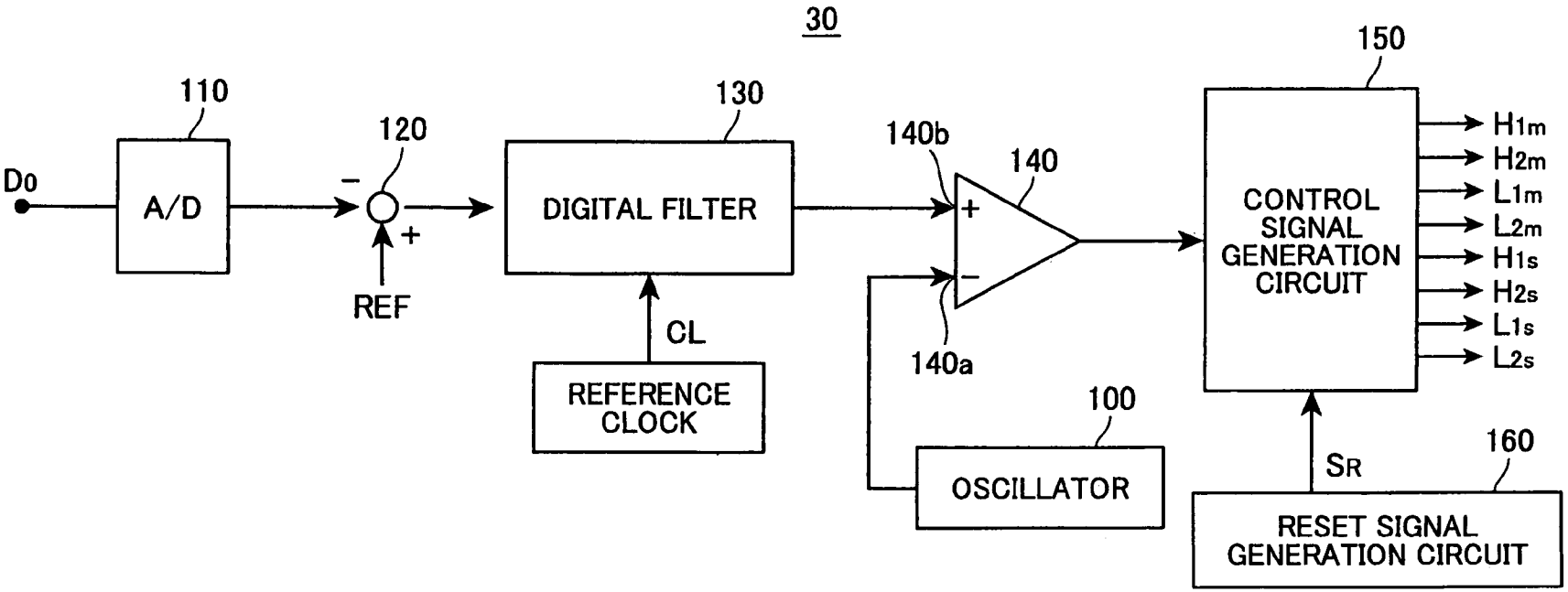
FIG. 3 is a block diagram showing the control circuit.

FIG. 3 shows a block diagram of the control circuit 30 in detail. Referring to FIG. 3, the control circuit 30 includes an oscillator 100, an A/D converter 110, a subtractor 120, a digital filter 130, a comparator 140, and a control signal generation circuit 150.

The oscillator 100 generates a triangular wave which serves as a criterion for generating control signals $H_{1m}$, $H_{2m}$, $L_{1m}$, $L_{2m}$, $H_{1s}$, $H_{2s}$, $L_{1s}$, and $L_{2s}$. The oscillator 100 sends the triangular wave to an inverting input terminal 140*a* of the comparator 140.

The A/D converter 110 is connected to the current detection terminal $D_0$. The A/D converter 110 receives the detected lamp current I via the current detection terminal $D_0$ to convert the lamp current to a digital signal having a corresponding level and then send the digital signal to the subtractor 120.

The subtractor 120 subtracts the output of the A/D converter 110 from a reference value REF to generate the subtraction result.

The digital filter 130 is made from an integrator to integrate the output signal of the subtractor 120 every time a reference clock CL is received. Then the digital filter 130 sends the integrated value of the output signal to the non-inverting input terminal 140*b* of the comparator 140. The reference clock CL has a considerably higher frequency than the switching frequency of each switching element. When the supply of the reference clock to the digital filter 130 is stopped, the digital filter 130 retains the integrated value until the next reference clock is supplied.

The comparator 140 receives the output of the digital filter 130 and the triangular wave generated by the oscillator 100 via the non-inverting input terminal 140*b* and via the inverting input terminal 140*a*, respectively. The output terminal of the comparator 140 is connected to the control signal generation circuit 150. The comparator 140 generates an output signal corresponding to a magnitude relation between two input signals through the input terminals 140*a* and 140*b*.

The control signal generation circuit 150 receives the output of the comparator 140 to set the durations of control signals $H_{1m}$, $H_{2m}$, $L_{1m}$, $L_{2m}$, $H_{1s}$, $H_{2s}$, $L_{1s}$, and $L_{2s}$ based on the output from the comparator 140. The control signal generation circuit 150 sets the timings of the switching operations using the control signals to be supplied to the inverter circuits 22A and 22B. The control signal generation circuit 150 then sends the above settings as the control signals $H_{1m}$, $H_{2m}$, $L_{1m}$, $L_{2m}$, $H_{1s}$, $H_{2s}$, $L_{1s}$, and $L_{2s}$ to corresponding switching elements to cause the inverter circuits 22A and 22B to perform predetermined switching operations. The control signal generation circuit 150 is also connected to a reset signal generation circuit 160. When receiving a reset signal $S_R$ from the reset signal generation circuit 160 as an input, the control signal generation circuit 150 stops the supply of the control signals to the inverter circuits 22A and 22B, and resumes the supply of the control signals when the lighting time period $T_{on}$ is started.

Next, an operation of the discharge lamp lighting device 10 having the above configuration will be described with reference to FIGS. 1 to 3. The control circuit 30 lights the discharge lamp L using burst dimming control. In the burst dimming control, lighting/lights-off of the discharge lamp L is repeated at a frequency from 100 to 300 Hz. One cycle $T_0$ of the burst dimming control includes one lighting time period $T_{on}$ during which the discharge lamp L emits light and one lights-off time period $T_{off}$ during which the discharge lamp L is extinct (see FIG. 2A). During the lighting time period $T_{on}$, the control circuit 30 causes the discharge lamp L to be supplied with a lamp current I from the inverter circuits 22A and 22B to light the discharge lamp L. On the other hand, in the lights-off time period $T_{off}$, the control circuit 130 stops the supply of the lamp current I to the discharge lamp L in accordance with the reset signal $S_R$ to turn off the discharge lamp L (see FIG. 2B).

The control circuit 30 controls the lighting of the discharge lamp L by dividing the lighting time period $T_{on}$ into two time periods: a first time period $T_1$ immediately after the discharge lamp L starts lighting and a second time period $T_2$ following the first time period $T_1$. In this embodiment, the length of the first time period $T_1$ is set to 0.4 ms, which is 1.0% of the entire length of one cycle. The control circuit 30 sets the reference value REF to a smaller current value $I_i$ than a target lamp current value $I_0$ corresponding to a target brightness value of the discharge lamp L at the start of the first time period $T_1$. The control circuit 30 then gradually increases the reference value REF up to the target lamp current value $I_0$ at the end of the first time period $T_1$. The reference value REF is fixed to the target lamp current value $I_0$ over the second time period $T_2$ (see FIG. 2C).

When the lighting time period $T_{on}$ or the first time period $T_1$ is started at time $t_1$, the control signals $H_{1m}$, $H_{2m}$, $L_{1m}$, $L_{2m}$, $H_{1s}$, $H_{2s}$, $L_{1s}$, and $L_{2s}$ from the control signal generation circuit 150 are supplied to the master circuit 20A and slave circuit 20B to flow a current to the discharge lamp L from the master circuit 20A and slave circuit 20B, respectively. Accordingly, the lamp current I starts flowing through the discharge lamp L. The lamp current I flows into the A/D converter 110 via the current detection terminal $D_0$ to be converted to a digital signal. The digitized lamp current I is then subtracted from the reference value REF corresponding to a smaller value than the target current value $I_0$ by the subtractor 120, and is supplied from the subtractor 120. In the first time period $T_1$, the reference value REF is gradually increased from $I_i$ up to $I_0$ (see FIG. 2C). The output from the subtractor 120 is integrated by the digital filter 130 every time the digital filter 130 receives a reference clock. The integrated value is transferred to the comparator 140 through the non-inverting input terminal 140*b*.

On the other hand, the comparator 140 receives the triangular wave from the oscillator 100 through the inverting-input terminal 140*a*. The control signal generation circuit 150 generates the control signals $H_{1m}$, $H_{2m}$, $L_{1m}$, $L_{2m}$, $H_{1s}$, $H_{2s}$, $L_{1s}$, and $L_{2s}$ based on the output from the comparator 140. The control signals $H_{1m}$, $H_{2m}$, $L_{1m}$, $L_{2m}$, $H_{1s}$, $H_{2s}$, $L_{1s}$, and $L_{2s}$ have the durations and the phase differences between the corresponding control signals to flow the lamp current I as the target current in the discharge lamp L (see FIGS. 2E and 2F).

When the first time period $T_1$ is ended and second time $T_2$ is started at time $T_2$, the reference value REF is fixed to the value $I_0$ corresponding to the target lamp current I (see FIG. 2C). And the control circuit 30 starts the feedback control for the lamp current I.

When the second time period $T_2$ or the lighting time period $T_{on}$ is ended at time $T_3$, the reset signal $S_R$ is sent to the control signal generation circuit 150. Upon receiving the reset signal $S_R$, the control signal generation circuit 150 stops the application of the control signals to the master and slave circuits 20A and 20B. At the same time, the supply of the reference clock to the digital filter 130 is stopped. The digital filter 130 then starts retaining the integrated value obtained at time $t_3$.

When the lights-off time period $T_{off}$ is ended and the next lighting time period $T_{on}$ is started at time $t_4$, a current supply from the mater and slave circuits 20A and 20B to the discharge lamp L is resumed to allow the lamp current I to flow through the discharge lamp L. At the same time, the supply of the reference clock to the digital filter 130 is resumed. At this time, the digital filter 130 retains the integrated value set at previous time $t_3$ (see FIG. 2D). Accordingly, the durations of and the phase differences between the control signals $H_{1m}$, $H_{2m}$, $L_{1m}$, $L_{2m}$, $H_{1s}$, $H_{2s}$, $L_{1s}$, and $L_{2s}$ can be set to values proximate to the values used during the second time period T2 of the previous lighting time period $T_{on}$. As a result, the lamp current I can be increased up to the target lamp current value I0 within a comparatively short time period (see FIG. 2G).

As described above, after time $t_4$, the burst dimming control is used to control the lighting of the discharge lamp L. By gradually increasing the reference value REF from the smaller value $I_i$ than the $I_0$ to the value corresponding to the target current value $I_0$ immediately after the start of the lighting time period $T_{on}$, an overshoot of the lamp current I can be prevented from occurring immediately after the start of the lighting time period $T_{on}$. On the contrary, if the target value $I_0$ is set as the reference value REF immediately after the start of the lighting time period $T_{on}$, the output level of the subtractor 120 is sufficiently large so that actions of the feedback control on the lamp current I becomes excessive, which may lead to the overshoot of the lamp current I.

When the reference value REF is gradually increased from the smaller value $I_i$ than the $I_0$ in the lighting time period $T_{on}$, the rise time of the lamp current I becomes longer as compared to the case where the reference value REF corresponding to the target current value $I_0$ is used immediately after the start of the lighting time period $T_{on}$. Accordingly, more time is required for the value of a current actually flowing through the discharge lamp L to reach the target current value $I_0$.

Generally, when the digital filter 130 is reset at the start of the lighting time period $T_{on}$, a long time is required for the integrated value by the digital filter 130 to reach a certain level. Further, a considerable time is required to increase the durations of the control signals so as to increase the lamp current I up to the target current value. However, in this embodiment, the digital filter 130 does not reset the integrated value, but retains the value integrated until the end of the previous lighting time period $T_{on}$. And the digital filter 130 resumes integration beginning from the retained integrated value when the next lighting time period $T_{on}$ is started. Therefore, since the durations of the control signals are set to large values at the time immediately after the start of the lighting time period $T_{on}$, the lamp current value can be readily increased up to the target current value I0 in a shorter time period as compared to the conventional case in which the digital filter 130 is reset.

As described above, the supply of the reference clock to the digital filter 130 is stopped and the digital filter 130 starts retaining the integrated value during the previous lights-off time period $T_{off}$. The value of a current to be used in the feedback control is increased up to the target value $I_0$ from a value smaller than the $I_0$ immediately after the start of the lighting time period $T_{on}$. The above configuration enables the control for adjusting the lamp current I to the target current value within the lighting time period $T_{on}$ while preventing occurrence of the overshoot of the lamp current I and reducing the time required for the lamp current I to rise.

Figure 4:
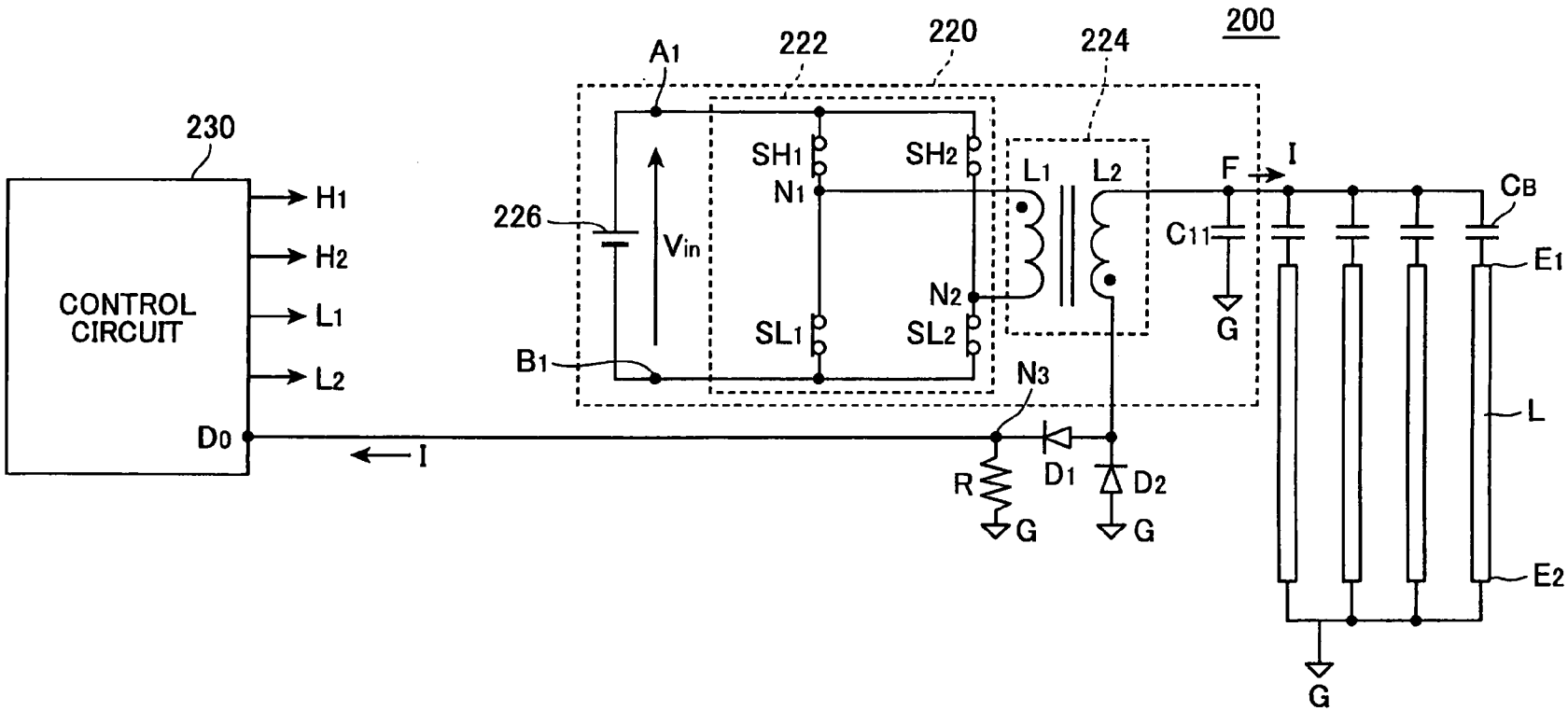
FIG. 4 is a circuit diagram showing a discharge lamp lighting device according to a second embodiment of the present invention.

Next description will be made for explaining a discharge lamp lighting device 200 according to a second embodiment of the present invention with reference to FIG. 4. Referring to FIG. 4, the discharge lamp lighting device 200 feeds electric power from a power supply to a discharge lamp L to light the discharge lamp L. The discharge lamp lighting device 200 includes a driver circuit 220 and a controller 230.

The driver circuit 220 includes an inverter circuit 222, a transformer 224, and a resonant capacitor $C_{11}$. A DC power supply 226 is connected to input terminals $A_1$, $B_1$ of the inverter circuit 222, so that a DC voltage $V_{in}$ from the DC power supply 226 is applied across the inverter circuit 222. The terminal $B_1$ is positioned at a lower potential than the terminal $A_1$.

The inverter circuit 222 is a full-bridge type of inverter having four switching elements $SH_1$, $SL_1$, $SH_2$, and $SL_2$. The switching elements $SH_1$, $SL_1$ are connected in series between input terminals $A_1$, $B_1$. The switching elements $SH_1$ is positioned at a higher potential than the switching elements $SL_1$. The switching elements $SH_2$, $SL_2$ are connected in series between the input terminals $A_1$, $B_1$. The switching elements $SH_2$ is positioned at a higher potential than the switching elements $SL_2$. The connecting point $N_1$ between the switching elements $SH_1$, $SL_1$ and the connecting point $N_2$ between the switching elements $SH_2$, $SL_2$ are a pair of output terminals of the inverter circuit 222. In this embodiment, the switching elements $SH_1$, $SL_1$, $SH_2$, and $SL_2$ are configured by semiconductor switching elements such as field-effect transistors. The switching operations of the switching elements $SH_1$, $SL_1$, $SH_2$, and $SL_2$ are controlled by control signals $H_1$, $H_2$, $L_1$, and $L_2$ supplied from the controller 230, respectively. When supplied with the control signal having a high level, the switching element turns on. When supplied with the control signal having a low level, the switching element turns off.

The transformer 224 includes a primary coil $L_1$ and a secondary coil $L_2$ which are wound in the manner that the polarity of the primary coil $L_1$ is oriented in the opposite direction to the polarity of the secondary coil $L_2$. The primary coil $L_1$ has two connecting ends connected to the output terminals $N_1$, $N_2$ of the inverter circuit 222, respectively. The secondary coil $L_2$ is connected to a reference potential G through one connecting end thereof, a diode $D_1$, a node $N_3$, and a resistor R. The diode $D_1$ and the resistor R are connected in series. The diode $D_1$ has an anode connected to the one connecting end of the secondary coil $L_2$, and a cathode connected to the node $N_3$. A current passes from the connecting end of the secondary coil $L_2$ to the reference potential G through the diode $D_1$ and the resistor R. The resistor R has a higher potential terminal connected to a current detecting terminal $D_0$ of the controller 230. A diode 12 is connected between the secondary coil $L_2$ and the reference potential G. The diode $D_{12}$ has an anode connected to the reference potential G and a cathode connected to the one connecting end of the secondary coil $L_2$.

The resonant capacitor $C_{11}$ is connected in parallel to the secondary coil $L_2$. One end of the resonant capacitor $C_{11}$ is connected to the reference potential G. The resonant capacitor $C_{11}$ has another end connected to another connecting end of the secondary coil $L_2$. A node between the resonant capacitor $C_{11}$ and the secondary coil $L_2$ is an output terminal F of the driver circuit 220. The output terminal F is electrically connected to the discharge lamp L through a ballast capacitor $C_B$ and one electrode $E_1$. The driver circuit 220 supplies an alternating current I through the output terminal F to the discharge lamp L. In this embodiment, the other electrode $E_2$ of the discharge lamp L is connected to the reference potential G directly.

Figure 5:
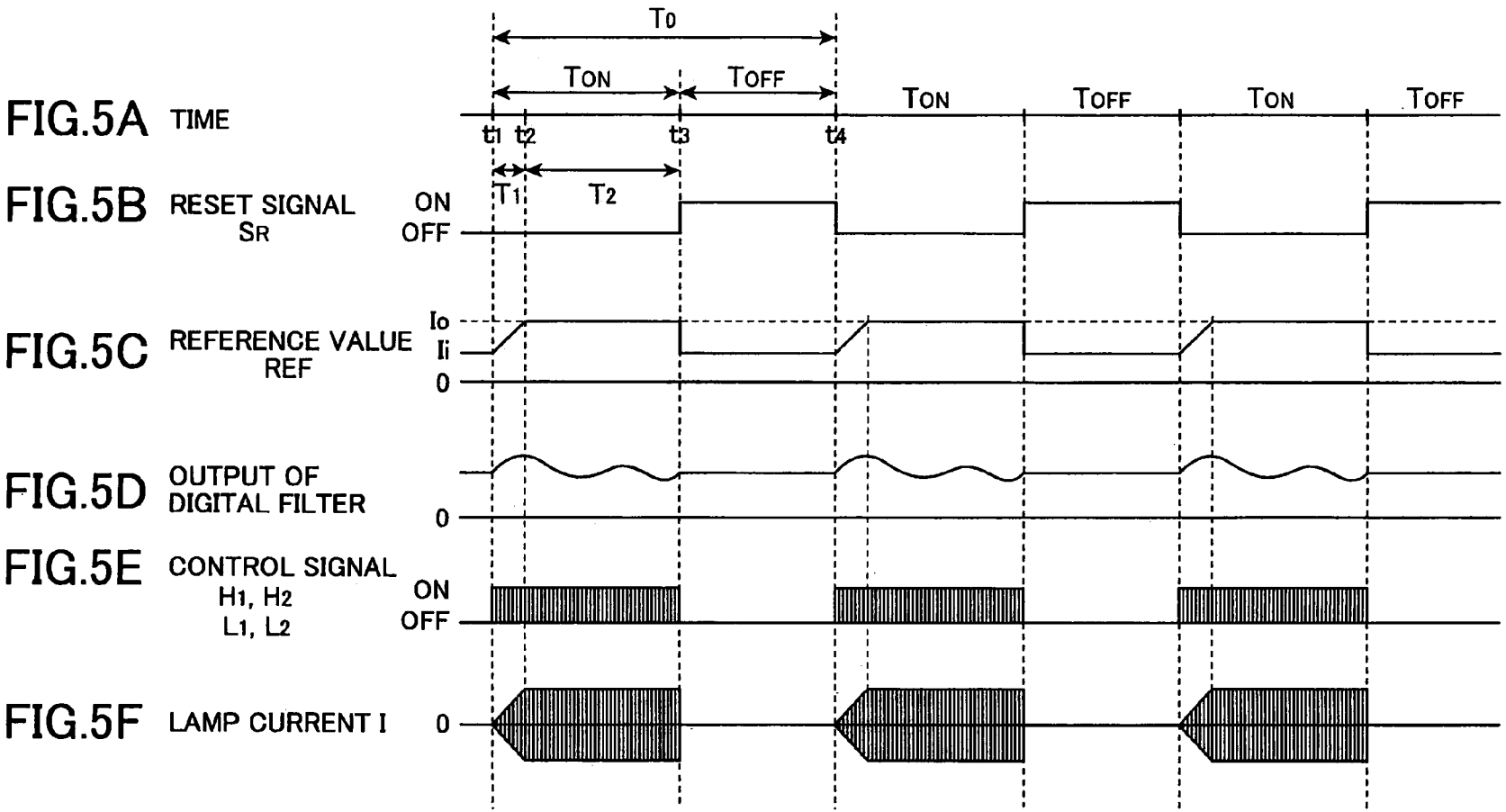
FIGS. 5A to 5F are waveform diagrams of control signals generated by a control circuit, a reference value REF used in the control circuit, and a lamp current.

The control circuit 230 is formed of a digital circuit. The control circuit 230 generates control signals $H_1$, $H_2$, $L_1$, and $L_2$ for the corresponding the switching elements $SH_1$, $SL_1$, $SH_2$, and $SL_2$ to perform a burst dimming control over the discharge lamp L to light the discharge lamp L. In the burst dimming control, one cycle consists of a lighting time period $T_{on}$ in which the discharge lamp L emits light and a lights-off time period $T_{off}$ in which the discharge lamp L extinguishes light, and the cycle is repeated as shown in FIG. 5. The ratio between the lighting time period $T_{on}$ and lights-off time period $T_{off}$ is determined depending on a target brightness value of the discharge lamp L. The control circuit 230 detects the first alternating current I flowing through the discharge lamp L as a lamp current I through the current detection terminal $D_0$. And then, the control circuit 230 performs a feedback control for the lamp current I to light the discharge lamp L at a target brightness. That is, the control circuit 230 controls the switching operations of the switching elements in the driver circuit 220 based on the detected lamp current value I, thereby adjusting the alternating current I.

Figure 6:
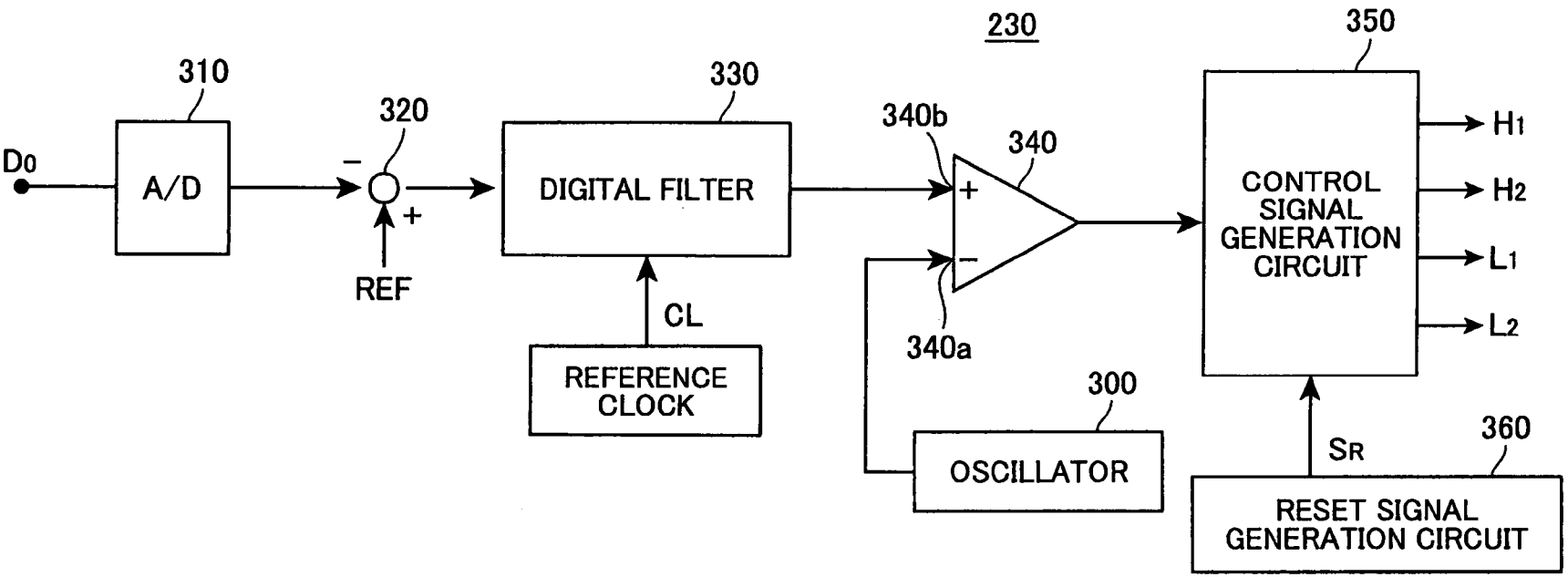
FIG. 6 is a block diagram showing the control circuit.

FIG. 6 shows a block diagram of the control circuit 230 in detail. Referring to FIG. 6, the control circuit 230 includes an oscillator 300, an A/D converter 310, a subtractor 320, a digital filter 330, a comparator 340, and a control signal generation circuit 350.

The oscillator 300 generates a triangular wave which serves as a criterion for generating control signals $H_1$, $H_2$, $L_1$, and $L_2$. The oscillator 300 sends the triangular wave to an inverting input terminal 340*a* of the comparator 340.

The A/D converter 310 is connected to the current detection terminal Do. The A/D converter 310 receives the detected lamp current I via the current detection terminal $D_0$ to convert the lamp current to a digital signal having a corresponding level and then send the digital signal to the subtractor 320.

The subtractor 320 subtracts the output of the A/D converter 310 from a reference value REF to generate the subtraction result.

The digital filter 330 is made from an integrator to integrate the output signal of the subtractor 320 every time a reference clock CL is received. Then the digital filter 330 sends the integrated value of the output signal to the non-inverting input terminal 340*b* of the comparator 340. The reference clock CL has a considerably higher frequency than the switching frequency of each switching element. When the supply of the reference clock to the digital filter 130 is stopped, the digital filter 330 retains the integrated value until the next reference clock is supplied.

The comparator 340 receives the output of the digital filter 330 and the triangular wave generated by the oscillator 300 via the non-inverting input terminal 340*b* and via the inverting input terminal 340*a*, respectively. The output terminal of the comparator 340 is connected to the control signal generation circuit 350. The comparator 340 generates an output signal corresponding to a magnitude relation between two input signals through the input terminals 340*a* and 340*b*.

The control signal generation circuit 350 receives the output of the comparator 340 to set the durations of control signals $H_1$, $H_2$, $L_1$, and $L_2$ based on the output from the comparator 340. The control signal generation circuit 350 sets the timings of the switching operations using the control signals to be supplied to the inverter circuit 222. The control signal generation circuit 350 then sends the above settings as the control signals $H_1$, $H_2$, $L_1$, and $L_2$ to corresponding switching elements to cause the inverter circuit 222 to perform predetermined switching operations. The control signal generation circuit 350 is also connected to a reset signal generation circuit 360. When receiving a reset signal $S_R$ from the reset signal generation circuit 360 as an input, the control signal generation circuit 350 stops the supply of the control signals to the inverter circuit 222, and resumes the supply of the control signals when the lighting time period Ton is started.

Next, an operation of the discharge lamp lighting device 200 having the above configuration will be described with reference to FIGS. 4 to 6. The control circuit 230 lights the discharge lamp L using burst dimming control. In the burst dimming control, lighting/lights-off of the discharge lamp L is repeated at a frequency from 100 to 300 Hz. One cycle $T_0$ of the burst dimming control includes one lighting time period $T_{on}$ during which the discharge lamp L emits light and one lights-off time period $T_{off}$ during which the discharge lamp L is extinct (see FIG. 5A). During the lighting time period $T_{on}$, the control circuit 230 causes the discharge lamp L to be supplied with a lamp current I from the inverter circuit 222 to light the discharge lamp L. On the other hand, in the lights-off time period $T_{off}$, the control circuit 230 stops the supply of the lamp current I to the discharge lamp L in accordance with the reset signal $S_R$ to turn off the discharge lamp L (see FIG. 5B).

The control circuit 230 controls the lighting of the discharge lamp L by dividing the lighting time period $T_{on}$ into two time periods: a first time period $T_1$ immediately after the discharge lamp L starts lighting and a second time period $T_2$ following the first time period $T_1$. In this embodiment, the length of the first time period $T_1$ is set to 0.4 ms, which is 1.0% of the entire length of one cycle. The control circuit 230 sets the reference value REF to a smaller current value $I_t$ than a target lamp current value $I_0$ corresponding to a target brightness value of the discharge lamp L at the start of the first time period $T_1$. The control circuit 230 then gradually increases the reference value REF up to the target lamp current value $I_0$ at the end of the first time period $T_1$. The reference value REF is fixed to the target lamp current value $I_0$ over the second time period $T_2$ (see FIG. 5C).

When the lighting time period $T_{on}$ or the first time period $T_1$ is started at time $t_1$, the control signals $H_1$, $H_2$, $L_1$, and $L_2$ from the control signal generation circuit 350 are supplied to the driver circuit 220 to flow a current to the discharge lamp L from the driver circuit 220. Accordingly, the lamp current I starts flowing through the discharge lamp L. The lamp current I flows into the A/D converter 310 via the current detection terminal $D_0$ to be converted to a digital signal. The digitized lamp current I is then subtracted from the reference value REF corresponding to a smaller value than the target current value $I_0$ by the subtractor 320, and is supplied from the subtractor 320. In the first time period $T_1$, the reference value REF is gradually increased from $I_i$ up to $I_0$ (see FIG. 5C). The output from the subtractor 320 is integrated by the digital filter 330 every time the comparator 330 receives a reference clock. The integrated value is transferred to the comparator 340 through the non-inverting input terminal 340*b*.

On the other hand, the comparator 340 receives the triangular wave from the oscillator 300 through the inverting-input terminal 340*a*. The control signal generation circuit 350 generates the control signals $H_1$, $H_2$, $L_1$, and $L_2$ based on the output from the comparator 340. The control signals $H_1$, $H_2$, $L_1$, and $L_2$ have the durations and the phase differences between the corresponding control signals to flow the lamp current I as the target current in the discharge lamp L (see FIGS. 5E and 5F).

When the first time period $T_1$ is ended and second time $T_2$ is started at time $T_2$, the reference value REF is fixed to the value $I_0$ corresponding to the target lamp current I (see FIG. 5C). And the control circuit 230 starts the feedback control for the lamp current I.

When the second time period $T_2$ or the lighting time period $T_{on}$ is ended at time $T_3$, the reset signal $S_R$ is sent to the control signal generation circuit 350. Upon receiving the reset signal $S_R$, the control signal generation circuit 350 stops the application of the control signals to the driver circuit 220. At the same time, the supply of the reference clock to the digital filter 330 is stopped. The digital filter 330 then starts retaining the integrated value obtained at time $t_3$.

When the lights-off time period $T_{off}$ is ended and the next lighting time period $T_{on}$ is started at time $t_4$, a current supply from the driver circuit 220 to the discharge lamp L is resumed to allow the lamp current I to flow through the discharge lamp L. At the same time, the supply of the reference clock to the digital filter 330 is resumed. At this time, the digital filter 330 retains the integrated value set at previous time $t_3$ (see FIG. 5D). Accordingly, the durations of and the phase differences between the control signals $H_1$, $H_2$, $L_1$, and $L_2$ can be set to values proximate to the values used during the second time period $T_2$ of the previous lighting time period $T_{on}$. As a result, the lamp current I can be increased up to the target lamp current value $I_0$ within a comparatively short time period (see FIG. 5F).

As described above, after time $t_4$, the burst dimming control is used to control the lighting of the discharge lamp L. By gradually increasing the reference value REF from the smaller value $I_i$ than the $I_0$ to the value corresponding to the target current value $I_0$ immediately after the start of the lighting time period $T_{on}$, an overshoot of the lamp current I can be prevented from occurring immediately after the start of the lighting time period $T_{on}$. On the contrary, if the target value $I_0$ is set as the reference value REF immediately after the start of the lighting time period $T_{on}$, the output level of the subtractor 320 is sufficiently large so that actions of the feedback control on the lamp current I becomes excessive, which may lead to the overshoot of the lamp current I.

When the reference value REF is gradually increased from the smaller value $I_i$ than the $I_0$ in the lighting time period $T_{on}$, the rise time of the lamp current I becomes longer as compared to the case where the reference value REF corresponding to the target current value $I_0$ is used immediately after the start of the lighting time period $T_{on}$. Accordingly, more time is required for the value of a current actually flowing through the discharge lamp L to reach the target current value $I_0$.

Generally, when the digital filter 330 is reset at the start of the lighting time period $T_{on}$, a long time is required for the integrated value by the digital filter 330 to reach a certain level. Further, a considerable time is required to increase the durations of the control signals so as to increase the lamp current I up to the target current value. However, in this embodiment, the digital filter 330 does not reset the integrated value, but retains the value integrated until the end of the previous lighting time period $T_{on}$. And the digital filter 330 resumes integration beginning from the retained integrated value when the next lighting time period $T_{on}$ is started. Therefore, since the durations of the control signals are set to large values at the time immediately after the start of the lighting time period $T_{on}$, the lamp current value can be readily increased up to the target current value I0 in a shorter time period as compared to the conventional case in which the digital filter 330 is reset.

As described above, the supply of the reference clock to the digital filter 330 is stopped and the digital filter 330 starts retaining the integrated value during the previous lights-off time period $T_{off}$. The value of a current to be used in the feedback control is increased up to the target value $I_0$ from a value smaller than the $I_0$ immediately after the start of the lighting time period $T_{on}$. The above configuration enables the control for adjusting the lamp current I to the target current value within the lighting time period $T_{on}$ while preventing occurrence of the overshoot of the lamp current I and reducing the time required for the lamp current I to rise.

In the above embodiments, the length of the first time period $T_1$ in the lighting time period $T_{on}$ is set to 1.0% of the entire length of one cycle of the burst dimming control. However, the length of the first time period in the lighting time period $T_{on}$ may be appropriately changed depending on the characteristics of the discharge lamp L, frequency used for the burst dimming control, or a target brightness of the discharge lamp L.

It is understood that the foregoing description and accompanying drawings set forth the preferred embodiments of the invention at the present time. Various modifications, additions and alternative designs will, of course, become apparent to those skilled in the art in light of the foregoing teachings without departing from the spirit and scope of the disclosed invention. Thus, it should be appreciated that the invention is not limited to the disclosed embodiments but may be practiced within the full scope of the appended claims.

What is claimed is:

1. A discharge lamp lighting device for lighting a discharge lamp, comprising:

a drive circuit connectable to the discharge lamp to feed alternating power having high frequency to the discharge lamp, thereby flowing a lamp current through the discharge lamp; and a control circuit for generating a drive pulse to drive the drive circuit to perform a burst dimming control over the discharge lamp, thereby alternately appearing a lighting time period for lighting the discharge lamp and a lights-off time period for turning off the discharge lamp, wherein the control circuit comprises:

detecting means for detecting the lamp current;

subtracting means for subtracting the detected lamp current from a reference value to obtain a difference therebetween as an output;

a digital filter operating as an integrator to integrate the output of the subtracting means to obtain an output; and pulse generating means for generating the drive pulse based on the output of the digital filter, the lighting time period comprises a first time period immediately after a start of the lighting time period and a second time period following the first time period, the second time period being longer than the first time period;

the control circuit sets the reference value to a target current value in the second time period, the control circuit increase the reference value in the first time period to the target current value until an end of the first time period, the digital filter retains the output obtained at an end of the lighting time period until a next lighting time period starts, the control circuit adjusts the lamp current to the target current value during the lighting time period.

2. A discharge lamp lighting apparatus for lighting a discharge lamp having two electrodes, comprising:

a first drive circuit connectable to one of the two electrodes to feed first alternating power having high frequency to the discharge lamp;

a second drive circuit connectable to the other of the two electrodes to feed a second alternating power to the discharge lamp, the second alternating power having the same frequency as the first alternating power;

a control circuit for generating first and second drive pulses to drive the first and second drive circuits, respectively to flow a lamp current through the discharge lamp, the control circuit performing a burst dimming control over the discharge lamp, thereby alternately appearing a light time period for lighting the discharge lamp and a lights-off time period for turning off the discharge lamp, wherein the control circuit comprises:

detecting means for detecting the lamp current;

subtracting means for subtracting the detected lamp current from a reference value to obtain a difference therebetween as an output;

a digital filter operating as an integrator to integrate the output of the subtracting means to obtain an output; and pulse generating means for generating the first and second drive pulse based on the output of the digital filter, the lighting time period comprises a first time period immediately after a start of the lighting time period and a second time period following the first time period, the second time period being longer than the first time period;

the control circuit sets the reference value as a target current value in the second time period, the control circuit increases the reference value in the first time period to the target current value until an end of the first time period, the digital filter retains the output obtained at an end of the lighting time period until a next lighting time period starts, the control circuit adjusts the lamp current to the target current value during the lighting time period.

* * * * *